US009194668B2

(12) United States Patent
Ronen et al.

(10) Patent No.: US 9,194,668 B2
(45) Date of Patent: Nov. 24, 2015

(54) ENERGETIC UNIT BASED ON SEMICONDUCTOR BRIDGE

(75) Inventors: Aviv Ronen, D.N. Hof HaCarmel (IL); Yair Baruchi, Haifa (IL); Eran Zvulun, Even Yehuda (IL)

(73) Assignee: RAFAEL ADVANCED DEFENSE SYSTEMS LTD., Haifa (IL)

( * ) Notice: Subject to any disclaimer, the term of this patent is extended or adjusted under 35 U.S.C. 154(b) by 0 days.

(21) Appl. No.: 14/128,730

(22) PCT Filed: Jun. 21, 2012

(86) PCT No.: PCT/IL2012/000253

§ 371 (c)(1), (2), (4) Date: Feb. 18, 2014

(87) PCT Pub. No.: WO2012/176198

PCT Pub. Date: Dec. 27, 2012

(65) Prior Publication Data

US 2014/0208972 A1 Jul. 31, 2014

(30) Foreign Application Priority Data

Jun. 23, 2011 (IL) ..... 213766

(51) Int. Cl.
*F42B 3/12* (2006.01)
*F42B 3/13* (2006.01)

(52) U.S. Cl.
CPC ..... *F42B 3/121* (2013.01); *F42B 3/128* (2013.01); *F42B 3/13* (2013.01)

(58) Field of Classification Search
CPC ..... F42B 3/103; F42B 3/12; F42B 3/124; F42B 3/125; F42B 3/121; F42B 3/13; F42B 3/128
USPC ..... 102/202.5, 202.7, 202.9, 202.14
See application file for complete search history.

(56) References Cited

U.S. PATENT DOCUMENTS

| | | | | |
|---|---|---|---|---|
| 3,366,055 | A * | 1/1968 | Hollander, Jr. | 102/206 |
| 3,426,682 | A * | 2/1969 | Coler et al. | 102/202.9 |
| 3,815,507 | A * | 6/1974 | Irish et al. | 102/202.8 |
| 4,040,356 | A * | 8/1977 | Voreck et al. | 102/202.14 |
| 4,708,060 | A | 11/1987 | Bickes, Jr. et al. | |
| 4,819,560 | A | 4/1989 | Patz et al. | |
| 4,831,933 | A | 5/1989 | Nerheim et al. | |
| 4,840,122 | A | 6/1989 | Nerheim | |
| 4,869,170 | A | 9/1989 | Dahmberg et al. | |
| 5,370,053 | A * | 12/1994 | Williams et al. | 102/202.5 |
| 5,861,570 | A | 1/1999 | Bickes, Jr. et al. | |
| 7,322,294 | B1 | 1/2008 | Laib | |
| 7,690,303 | B2 * | 4/2010 | Reynolds et al. | 102/202.14 |
| 2010/0065962 | A1 | 3/2010 | Bayerer et al. | |
| 2014/0208972 | A1 * | 7/2014 | Ronen et al. | 102/202.7 |

OTHER PUBLICATIONS

International Search Report of PCT/IL2012/000253 dated Jan. 8, 2013.

* cited by examiner

*Primary Examiner* — Joshua Freeman
(74) *Attorney, Agent, or Firm* — Venable LLP; Robert Kinberg

(57) ABSTRACT

The invention is an energetic unit comprised of: a container comprised of a base, an upper part, and a cover; a substrate located in the base and comprised of a thin, ribbon-like strip of flexible material that provides electrical contact to external firing circuits; a semiconductor bridge (SCB) chip electrically and physically attached to the substrate; and one or more layers of energetic material which, are packed into the upper part of the container between the SCB chip and the cover.

10 Claims, 5 Drawing Sheets

ENERGETIC UNIT BASED ON SEMICONDUCTOR BRIDGE

FIELD OF THE INVENTION

The invention is related to the field of igniters/detonators. Specifically the invention relates to small sized igniters/detonators based on semiconductor bridges and manufactured using MEMS technology.

BACKGROUND OF THE INVENTION

Explosive devices are normally designed to be activated by means of a chain of explosions in which, initiation/ignition of a small quantity of sensitive explosive material, ignites a larger quantity of more powerful and less sensitive material. This in turn ignites a larger quantity of more powerful and less sensitive material, and so forth up the chain until the main explosive charge is ignited. The main reason for the explosive chain is safety, since removal of any one of the links in the chain prevents the ignition of the link above it.

Depending on the type of energetic material that is inside of it the first element in the chain is known by many different names, e.g. igniter, detonator, initiator, and squib. Herein the generic term "energetic unit" will be used to refer to any or all of this type of element that is used in applications including but not limited to: initiating an exploding train in "Safe and Arm" systems, mines, and other exploding application; initiating thermal batteries by activating there thermo-electric layers; and ignition of rocket motors. Energetic units can take many forms from a simple match to sophisticated semiconductor devices.

A type of igniter that is commonly used today in military applications is known as a "hot wire igniter". Such igniters are well known and documented in the prior art. They are composed of a segment of electric wire connected in series to two electrodes. The segment of wire is in thermal contact with a quantity of very sensitive energetic material. Passing an electric current through the wire causes its temperature to rise until the heat generated in the wire is sufficient to ignite the energetic material. In some embodiments of hot wire igniter the hot wire is connected between an electrode and a metal casing that functions as one of the electrodes. Related types of igniter are "exploding wire igniters" and "exploding foil igniters" in which a high voltage is applied causing the wire to melt and a shock wave that ignites the energetic material.

The structure of the hot wire igniter—specifically the requirement of a minimal length to the hot wire, the diameters of the electrode wire and surrounding electrical insulation, and the energy requirements—limits the ability to design miniaturized systems that depend on these igniters for activation. Examples of applications of such miniaturized systems are very small thermal batteries for use in a variety of applications and small diameter munitions.

Since many applications that employ thermal batteries are located in environments, e.g. rockets and missiles, in which both space and energy are in very short supply there is an increasing interest on developing new types of energetic unit that provide a response to the design challenges of reducing both size and energy requirement.

One promising approach has been the development of devices produced using semiconductor technology. A semiconductor bridge technology has been described in the literature and a few patent documents, e.g. U.S. Pat. No. 4,708,060, U.S. Pat. No. 4,819,560, and U.S. Pat. No. 5,861,570. In these devices a segment of doped or undoped semiconductor matter acts as a bridge between two 30 conducting lands. When an electrical potential is applied to the lands an electric current flows through the bridge creating a plasma which ignites an energetic material that is in contact with or in close proximity to the bridge. To the best of the knowledge of the inventor no commercial use, at least not in military applications, has been made of this technology.

It is a purpose of the present invention to provide a miniaturized energetic unit that can be used in a variety of applications.

It is another purpose of the present invention to provide a miniaturized energetic unit that is activated by a very small quantity of energy.

It is another purpose of the present invention to provide a miniaturized energetic unit that is manufactured using techniques of MEMS technology, thereby allowing not only extreme miniaturization but also low expense.

Further purposes and advantages of this invention will appear as the description proceeds.

SUMMARY OF THE INVENTION

The invention is an energetic unit comprised of:

a) a container comprised of a base, an upper part, and a cover;

b) a substrate that provides electrical contact to external firing circuits, the substrate located in the base;

c) a semiconductor bridge (SCB) chip electrically and physically attached to the substrate;

d) and one or more layers of energetic material which are packed into the upper part of the container between the SCB chip and the cover;

characterized in that the substrate is a thin, ribbon-like strip of flexible material.

In embodiments of the energetic unit the flexible substrate passes through one side of the case to allow connection to external circuit elements on one side of the energetic unit. In other embodiments the flexible substrate passes through two sides of the case to allow connection to external circuit elements on two sides of the energetic unit. The flexible material of the substrate can be Kapton®.

In embodiments of the energetic unit the SCB chip is attached to the top of the flexible substrate such that the SCB chip is in direct physical contact with the lowermost layer of energetic material. In these embodiments electrical continuity between electrical contacts on the substrate and lands on the SCB chip is made possible by metal filled vias that have been created through a layer of silicon on which the SCB structure is created.

In embodiments of the energetic unit the flexible substrate is located on top of the SCB chip such that the flexible substrate is in direct physical contact with the lowermost layer of energetic material. In these embodiments an open window is created through the flexible substrate over a polysilicone bridge of the SCM chip to allow a plasma that is created from the activation of the polysilicone bridge to activate the energetic material above the flexible substrate.

In embodiments of the invention security is provided to the energetic unit by designing the external firing circuit such that a current flows in the circuit and via the flexible substrate to activate the SCB only when desired. In these embodiments the external firing circuit can be integrated into the SCB chip.

In embodiments of the invention security is provided to the energetic unit by means of an electronic switch created on the chip at the same time that the SCB is created. These embodiments can also comprise decoding circuitry creating on the SCB chip. Activation of the electronic switch is only allowed if a specific coded signal is input to the SCB chip via the flexible substrate and recognized by the decoding circuitry.

All the above and other characteristics and advantages of the invention will be further understood through the following illustrative and non-limitative description of embodiments thereof, with reference to the appended drawings. In the drawings the same numerals are sometimes used to indicate the same elements in different drawings.

DETAILED DESCRIPTION OF EMBODIMENTS OF THE INVENTION

Although the semiconductor bridge (SCB), associated electrical circuitry, and the energetic materials used are obvious essential features of an energetic unit based on their use, the details of their structure and manufacturing methods are well known in the art and will not be discussed in detail herein. The main innovation of the present invention is in the integration of these elements into a unit having significantly smaller volume than presently available energetic units and in embodiments in which a single semiconductor chip on which the SCB is constructed is adapted to provide high level capabilities.

Figure 1A:
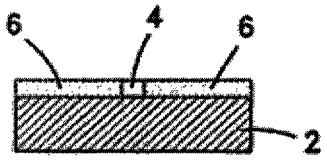
FIG. 1A and FIG. 1B show schematically the SCB structure.
Figure 1B:
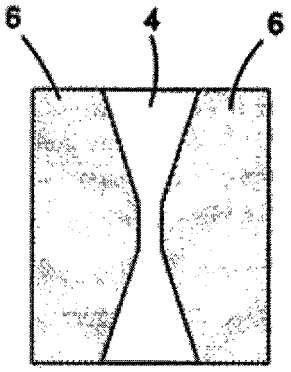

FIG. 1A and FIG. 1B show schematically the SCB structure. The bridge consists of a silicon substrate 2 on which metal is deposited to form two lands 6. Between the lands 6 an area 4 comprised of a layer of polysilicon is created. Semiconductor chips having a SCB and, in some embodiments, circuitry to provide additional safety features that will be described herein below are produced using methods known in the field of MEMS technology.

The SCB chips are then attached to substrates that provide the electrical contact to external firing circuits and enable the SCB to be physically integrated into an explosive device. In the present invention, the substrate is a thin, ribbon-like strip of flexible material, for example a Kapton® based PCB. Two of the advantages of using a flexible substrate, as opposed to the rigid substrates of the prior art, are that the energetic unit can be moved in any direction while still attached to the system into which it is integrated and soldering the energetic unit to the electric circuit can be accomplished far from the energetic material, thereby increasing the safety of the assembly procedure.

Figure 2:
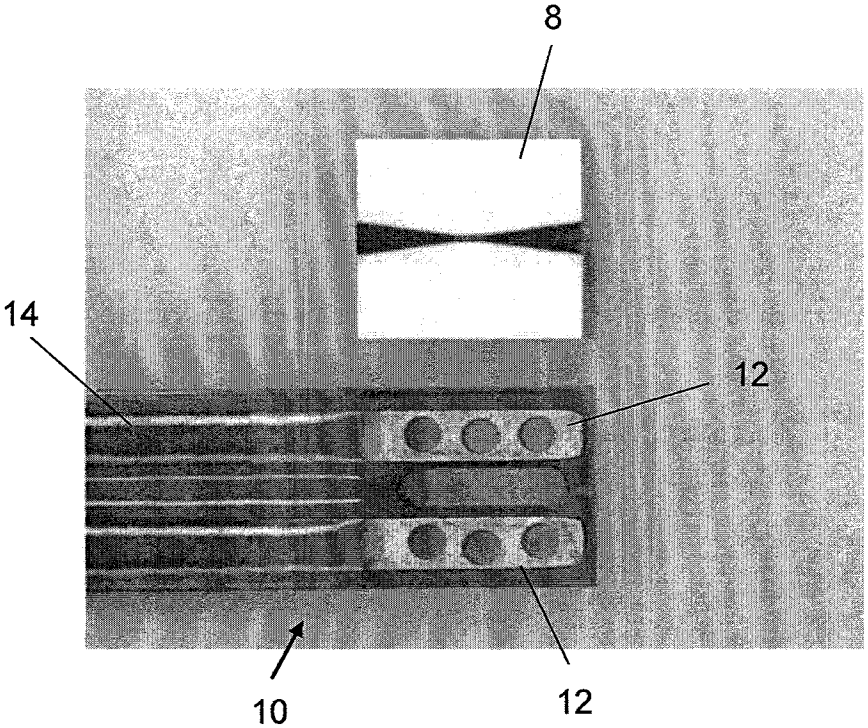
FIG. 2 shows an SCB chip and a flexible substrate according to an embodiment of the invention.

FIG. 2 shows a flexible substrate 10 on which is created metal contacts 12 to which SCB chip 8 will be physically and electrically connected and conducting lines 14 leading to an external circuit. The substrate 10 is illustrated with the contacts 12 located at one of its ends; however, depending on the application, embodiments of substrate 10 can have contacts 12 located at its "middle" allowing connection to external circuit elements on both sides of chip 8.

Figure 3A:
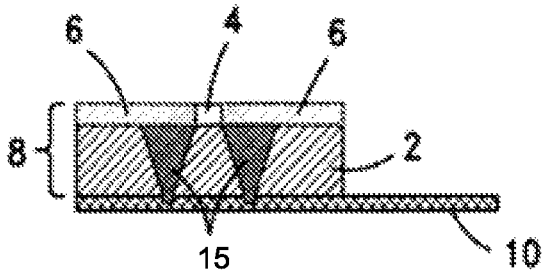
FIG. 3A and FIG. 3B schematically show two methods of attaching a SCB 15 chip to a flexible substrate according to the present invention.
Figure 3B:
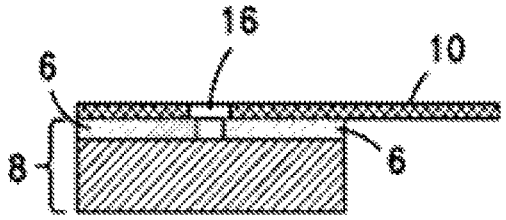

FIG. 3A and FIG. 3B schematically show two methods of attaching a SCB chip 8 to a flexible substrate 10 according to the present invention. Chip 8 is shown positioned on top of flexible substrate 10 in FIG. 3A. In this case 30 electrical continuity between the contacts 12 on the substrate 10 and lands 6 is made possible by metal filled vias 15 that have been created through the layer of silicon 2 of chip 8. In FIG. 3B substrate 10 is located on top of chip 8. The lands 6 or bottoms of vias 15 of chip 8 are attached physically and connected electrically to the contacts 12 on flexible substrate 10 either by means of a suitable conducting adhesive or solder. In the embodiment 5 shown in FIG. 3B an open window 16 is created through substrate 10 over the polysilicone bridge to allow the plasma that is created from the SCB bridge to activate the energetic material above it.

Figure 4B:
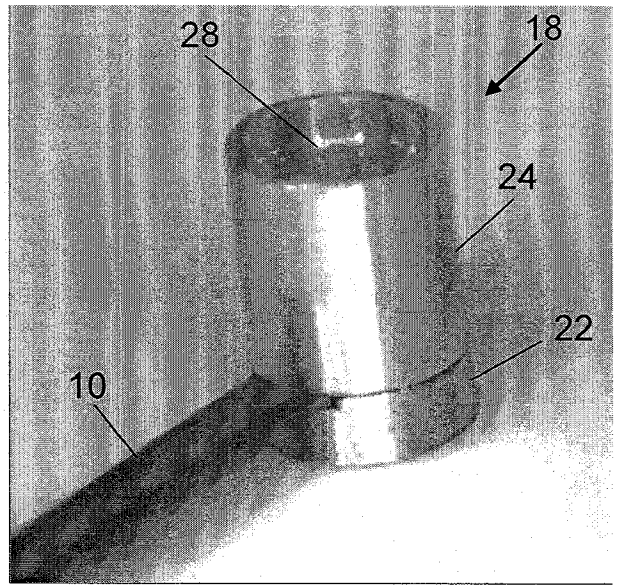
FIG. 4A and FIG. 4B are photographs showing respectively the base and a fully assembled energetic unit 18 according to the invention.
Figure 4A:
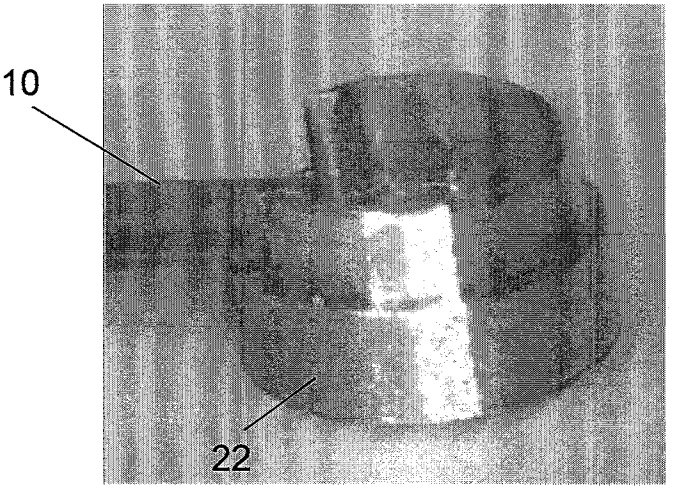

FIG. 4A and FIG. 4B are photographs showing respectively the base 22 and a fully assembled energetic unit 18 according to the present invention. Energetic unit 18 is comprised of flexible substrate 10 with attached SCB chip, a container 20 comprised of three main parts: a base 22, an upper part 24, and a cover 28, and energetic material, which is packed into container 20. Base 22 of container 20 has a recess into which the SCB chip 8 fits. The upper part 24, in the example shown as a cylindrical tube is attached to base 22, by press fitting them together, soldering, or using an adhesive. There is a slot at the interface between the upper part and base on one or both sides (depending on the embodiment) to allow the end/s of flexible substrate 10 to be connected to the external circuit. The interior of the upper part 24 of container 20 is filled with energetic material and its open top is sealed with cover 28. Cover 28 is manufactured in such a way that it will be easily ruptured by the explosion of the energetic material inside container 20, thereby initiating the explosion of the main energetic charge to which energetic unit 18 is attached. The parts of the container can be made of metal, e.g. steel and aluminum, or ceramic material, e.g. alumina ($Al_2O_3$) and aluminum nitride (AlN).

Figure 5:
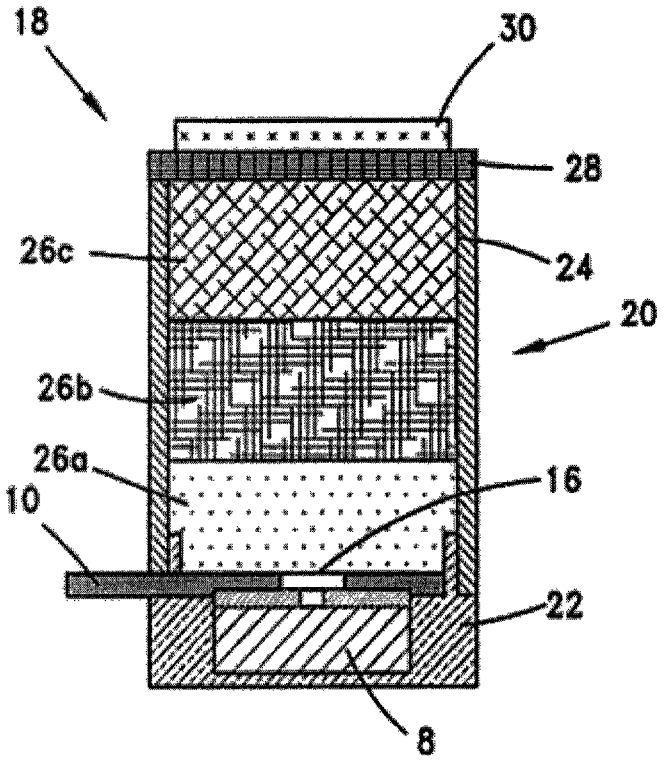
FIG. 5 is a cross-sectional view symbolically showing an assembled igniter assembly 18 according to the invention.

FIG. 5 is a cross-sectional view symbolically showing an assembled energetic unit 18 according to the invention. This figure together with FIG. 4A and FIG. 4B will now be used to describe one embodiment of the assembly procedure of energetic unit 18.

After the SCB chip 8 has been manufactured and connected to flexible substrate 10, the chip is placed into a recess in the base 22 of container 20 with the loose end of flexible substrate 10 extending to the outside of container 20 as shown in FIG. 4A. Then upper part 24 is attached to base 22 (FIG. 4B) now energetic material is pressed into the interior of container 20. In the example shown in FIG. 5 three different layers of energetic material are used. Material 26*a* is very sensitive, material 26*b* less sensitive, and material 26*c* the least sensitive. Finally cover 28 is sealed to the circumference of container 20 over the top of the layer 26*c* of energetic material. With this arrangement of energetic material, application of an electric potential difference between lands 6 of the SCB chip, initiates an explosive chain in which the first step is the creation of a plasma that causes material 26*a* to explode, causing material 26*b* to explode, which explosion causes material 26*c* to explode. The explosion of material 26*c* releases enough energy to rupture cover 28 and to cause the main explosive charge, symbolically shown in FIG. 5 as layer 30, to explode.

The two primary and sometimes conflicting characteristics of an energetic unit that determine its suitability for use in most applications are its sensitivity, i.e. the energy requirement and speed with which the device can be activated, and safety, i.e. the resistance of the device to being accidentally activated. Regarding sensitivity, SCB initiators have been shown in the prior art to be the most sensitive initiators known in the art. The inventors have devised three embodiments of the present invention that deal with the level of security of the device. The lowest level of security is provided by the embodiment described herein above in which the chip 8 comprises only the semiconductor bridge. In this embodiment safety is provided by designing the external firing circuit, i.e. the electric circuit used to activate the SCB, such that a current flows in the circuit and via the flexible substrate to lands 6 only when desired. It is noted that in embodiments of the invention the "external" firing circuit is actually integrated into energetic unit, e.g. on the SCB chip. An embodiment that provides a higher level of security comprises an electronic switch created on the chip at the same time that the SCB is created. An even higher level of security is provided by also creating on the chip decoding circuitry that only allows activation of the electronic switch if a specific coded signal is input to the SCB chip via the flexible substrate and recognized by the decoding circuitry.

The embodiment of the energetic unit used as an initiator that has been built by the inventors and is shown in the photographs has a diameter of 4 mm and a height of 2.7 mm. The presently used standard hot wire igniters are 5 mm in diameter and 5 mm high not including the dimensions of the two metal pins that protrude from the lower end. The inventors have built an energetic unit for use as a detonator that has a diameter of 3.5 mm and height of 3 mm and are presently developing even smaller detonators. These significant reductions in dimensions over the prior art allows the energetic unit of the invention to be used in small size explosive devices that previously could not be built.

Although embodiments of the invention have been described by way of illustration, it will be understood that the invention may be carried out with many variations, modifications, and adaptations, without exceeding the scope of the claims.

The invention claimed is:

1. An energetic unit comprised of:

a) a container comprised of a base, an upper part attached to said base and having an open top, and a cover that seals the open top of said upper part;

b) a flexible substrate located in the base and comprising a thin ribbon strip of flexible material including metal contacts and conducting lines arranged to connect the metal contacts to an external circuit;

c) a semiconductor bridge (SCB) chip electrically and physically attached to said flexible substrate; and d) one or more layers of energetic material packed into said upper part of said container between said SCB chip and said cover;

wherein the SCB chip is physically and electrically connected to the metal contacts of the flexible substrate and the flexible substrate passes through;

i) one side of the container to allow connection via the conducting lines to an external firing circuit on one side of said energetic unit; or ii) two sides of the container to allow connection via the conducting lines to external firing circuits on two sides of said energetic unit.

2. The energetic unit of claim 1, wherein the flexible material is Kapton®.

3. The energetic unit of claim 1, wherein the SCB chip is attached to the top of the flexible substrate such that said SCB chip is in direct physical contact with the lowermost layer of energetic material.

4. The energetic unit of claim 3, wherein the SCB chip comprises a layer of silicon and includes metal lands, and electrical continuity between the metal contacts on the flexible substrate and the metal lands on the SCB chip is provided by metal filled vias that extend through the layer of silicon.

5. The energetic unit of claim 1, wherein the flexible substrate is located on top of the SCB chip such that said flexible substrate is in direct physical contact with the lowermost layer of energetic material.

6. The energetic unit of claim 5, wherein the flexible substrate has an open window over a polysilicone bridge of the SCM chip to allow a plasma that is created from the activation of said polysilicone bridge to activate the energetic material above said flexible substrate.

7. The energetic unit of claim 1, wherein security is provided by an external firing circuit that permits current to flow in the circuit and via the flexible substrate to activate the SCB only when desired.

8. The energetic unit of claim 7, wherein the external firing circuit is integrated into the SCB chip.

9. The energetic unit of claim 1, wherein security is provided by means of an electronic switch created on the chip at the same time that the SCB is created.

10. The energetic unit of claim 9, wherein security is provided by means of creating on the SCB chip decoding circuitry that only allows activation of the electronic switch if a specific coded signal is input to said SCB chip via the flexible substrate and recognized by said decoding circuitry.

* * * * *